United States Patent [19]

Blaese

[11] Patent Number: 5,041,842

[45] Date of Patent: Aug. 20, 1991

[54] HELICAL BASE STATION ANTENNA WITH SUPPORT

[76] Inventor: Herbert R. Blaese, 3314 Olcott Ave., Chicago, Ill. 60634

[21] Appl. No.: 510,866

[22] Filed: Apr. 18, 1990

[51] Int. Cl.[5] ..... H01Q 1/12; H01Q 1/36

[52] U.S. Cl. ..... 343/882; 343/892; 343/895

[58] Field of Search ..... 343/895, 838, 839, 834, 343/835, 878, 879, 880, 882, 892

[56] References Cited

U.S. PATENT DOCUMENTS

| | | | |
|---|---|---|---|
| 2,663,689 | 12/1953 | Adcock et al. | 343/895 |
| 3,419,875 | 12/1968 | Aasted | 343/895 |
| 3,449,752 | 6/1969 | Spitz et al. | 343/895 |
| 3,509,578 | 4/1970 | Cribb | 343/882 |
| 3,510,877 | 5/1970 | Turriere | 343/882 |
| 4,475,111 | 10/1984 | Gittinger et al. | 343/895 |
| 4,780,727 | 10/1988 | Seal et al. | 343/895 |

OTHER PUBLICATIONS

"The ARRL Antenna Book", published by the ARRL, Newington, Ct., 15th Edition, 1988, pp. 19-22 to 19-33.

*Primary Examiner*—Michael C. Wimer

*Attorney, Agent, or Firm*—Gerstman & Ellis, Ltd.

[57] ABSTRACT

A base station antenna is disclosed having a ground plane in the form of a coarse screen. The coarse screen is connected to a support member. A pair of helical radiators is coupled, through the support member, to the coarse screen with one of the helical radiators being pivotable about its axis to vary the polarization.

1 Claim, 1 Drawing Sheet

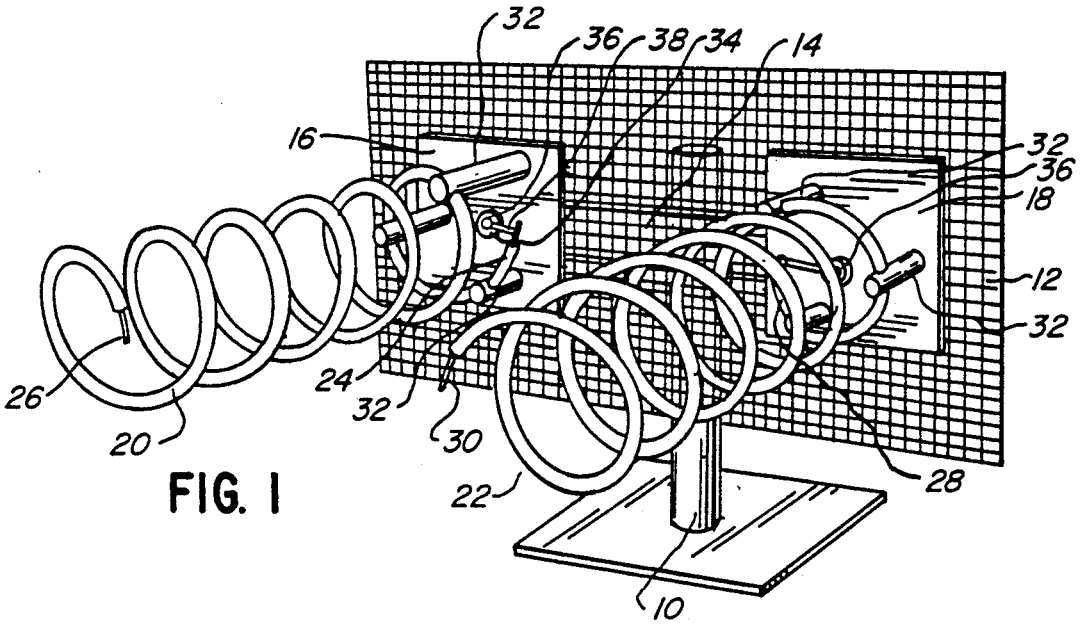
FIG. 1
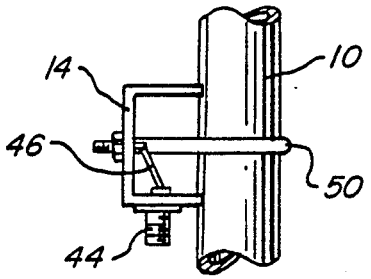
FIG. 4
FIG. 2
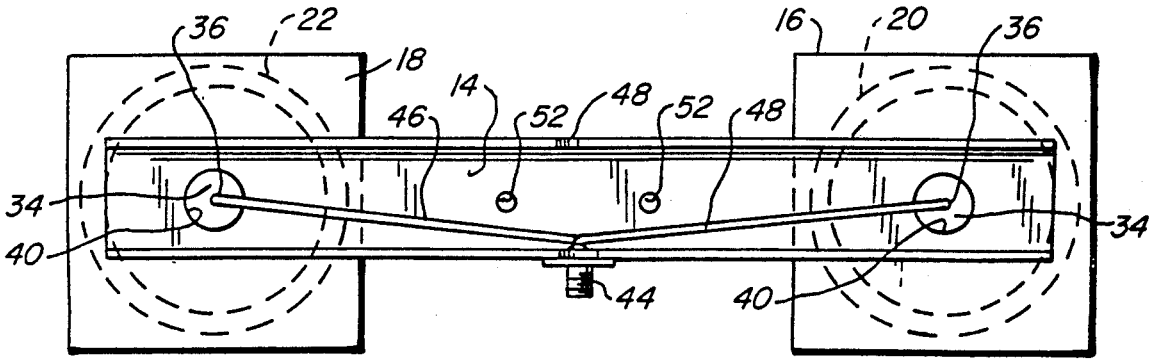
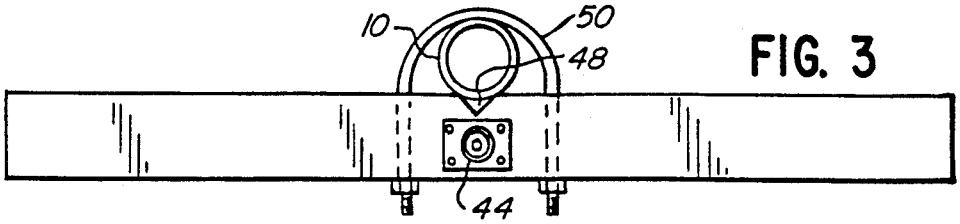
FIG. 3

HELICAL BASE STATION ANTENNA WITH SUPPORT

FIELD OF THE INVENTION

The present invention concerns a novel antenna which can be used as a base station antenna.

BACKGROUND OF THE INVENTION

In certain rural areas where there are no telephone lines, it would be desirable to utilize a cellular telephone. Often in such rural areas the cell site is at a substantial distance, and the typical cellular antenna may not be capable of useful transmission and reception due to the substantial distance of the cell.

I have discovered an antenna construction that is useful as a beam antenna, enabling it to be used as a base station antenna that can be directed toward a cell site for cellular transmission and reception, even where the cell site is at a substantial distance. Although the antenna is specifically described with respect to cellular transmission and reception, it is to be understood that the antenna of the present invention is also useful at other frequencies.

It is, therefore, an object of the present invention to provide an antenna which is useful as a beam antenna for cellular transmission and reception.

Another object of the present invention is to provide an antenna that has an adjustable polarization.

Other objects and advantages of the present invention will become apparent as the description proceeds.

SUMMARY OF THE INVENTION

In accordance with the present invention, an antenna is provided which includes a support member and a ground plane coupled to the support member. A helical radiator having a proximal end and a distal end is pivotally mounted adjacent the ground plane so that the helical radiator can be pivoted about its axis to vary the polarization.

In the illustrative embodiment, the helical radiator has an axis that is generally perpendicular to the plane of the ground plane. The ground plane is formed of a coarse electrically conductive screen material and there is provided a second helical radiator having a proximal end and a distal end with its axis generally perpendicular to the plane of the coarse screen. The second helical radiator is mounted adjacent the coarse screen in alongside relationship to the first helical radiator.

In the illustrative embodiment, the support member is formed of a rigid electrically conductive material and is adapted to be grounded. The pivotal mounting of one of the helical radiators is provided by a mounting plate having an electrically conductive portion conductively connected to the coarse screen and having an isolated portion conductively connected to the proximal end of the helical radiator. The mounting plate has insulative post members for carrying the helical radiator.

In the illustrative embodiment, the support member comprises a metal channel having a generally U-shaped cross-sectional configuration. The support member carries a coaxial connector and the mounting plate is also carried by the support member. The main conductor of a coaxial cable is connected through the cable connector to the proximal end of each of the helical radiators. The ground conductor of the coaxial cable is connected through the cable connector to the coarse screen.

A more detailed explanation of the invention is provided in the following description and claims, and is illustrated in the accompanying drawings.

BRIEF DESCRIPTION OF THE DRAWING

FIG. 1 is a perspective view of an antenna constructed in accordance with the principles of the present invention.

FIG. 2 is a rear view of the support member of the antenna of FIG. 1.

FIG. 3 is a bottom plan view thereof.

FIG. 4 is a side elevational view thereof, taken from the left side of FIG. 2.

DETAILED DESCRIPTION OF THE ILLUSTRATIVE EMBODIMENT

Referring to FIG. 1, the antenna of the present invention may be mounted to a mast 10 and comprises a coarse metal screen 12 operative as a ground plane, a support member 14 connected to mast 10 and positioned on the back side of screen 12, mounting plates 16 and 18 connected to support member 14 and positioned on the front side of screen 12, and helical radiators 20 and 22 connected to the mounting plate 16, 18, respectively, and positioned in alongside parallel relationship on the front of mounting plates 16 and 18 with their axes being perpendicular to the plane of screen 12.

Helical radiator 20 has a proximal end 24 and a distal end 26 while helical radiator 22 has a proximal end 28 and a distal end 30. Mounting plates 16 and 18 are primarily formed of an electrically conductive material but each carry plastic posts 32 for supporting its respective helical radiator.

Each of the mounting plates 16, 18 has an electrically isolated portion 34 with a central conductor 36. The proximal end of each of the helical radiators 20, 22 is electrically connected to their respective central conductor 36 via conductive strap 38, whereby conductors 36 form the feed points for the helical array.

Support member 14 is shown in detail in FIGS. 2 to 4. Referring to FIGS. 2 to 4, the support member 14 has a generally U-shaped cross-sectional configuration with openings 40 for access to isolated portions 34 of the mounting plates 16, 18. Support member 14 carries a coaxial connector 44 that is mounted so that the ground conductor of a coaxial cable will be grounded to the support member 14 while the central or main conductor of the coaxial cable is fed via conductors 46 and 48 to conductors 36 of the helical array.

Mounting plate 16 is connected to support plate member 14 by a pivotal connection to allow the mounting plate to pivot about conductors 36. In this manner, helical radiator 26 is pivotable, to vary the polarization.

It is to be understood that in accordance with the present invention only a single radiator can be used if desired, but this would render the antenna circularly polarized with the loss of gain between transmission and reception. It is found that linear polarization is most desirable, and two helixes are appropriate for such linear polarization.

Support member 14 defines a notch 48 for engaging mast 10 and carries an appropriate bracket 50 for embracing mast 10 to connect it securely to the support member 14. A pair of fasteners 52 are provided for aiding in securing support member 14 to coarse screen 12.

In the illustrative embodiment, as a specific example although no limitations are intended, the dual helix array illustrated herein has a frequency range of 750 MHz to 1,000 MHz with a 200 MHz bandwidth for a 1.5:1.0 standing wave ratio and a 300 MHz bandwidth for a 2.0:1 standing wave ratio. It has a gain of 13.5 db with its polarization adjustable from a vertical field to a horizontal field. It has a 500 watt maximum power with a horizontal plane bandwidth of 27 degrees. To achieve these electrical specifications, the screen 12 is 12 inches 24 inches with each of the helical radiators having six turns and an axial length of 20 inches. Helical radiator 20 is rotatable 180 degrees by rotating its mounting plate 16. Each of the helical coils is one wavelength in circumference, i.e. one wavelength of travel from one turn to the next.

It can be seen that a novel antenna has been provided in which the helical axes can be directed toward a cell site for transmission and reception of cellular signals. The helical array enables a broad banded operation which is particularly useful because cellular transmission is approximately 45 MHz away from reception in a 900 MHz cellular band.

Although an illustrative embodiment of the invention has been shown and described, it is to be understood that various modifications and substitutions may be made by those skilled in the art without departing from the novel spirit and scope of the present invention.

What is claimed is:

1. An antenna which comprises:

a horizontally disposed support member comprising a metal channel having a generally U-shaped cross-sectional configuration;

a screen formed of electrically conductive material for operation as a ground plane;

means for coupling said screen to said support member;

a helical radiator disposed along an axis and having a proximal end and a distal end;

means for pivotally mounting said helical radiator adjacent said screen, whereby said helical radiator can be pivoted about said axis to vary the polarization;

a vertical mast for supporting said antenna;

a U-shaped bolt for connecting said mast to said support member;

said support member defining a groove which cooperates with said U-shaped bolt to aid in clamping said mast to said support member.

* * * * *